US005628495A

United States Patent [19]

Gandara

[11] Patent Number: 5,628,495

[45] Date of Patent: May 13, 1997

[54] METAL FENCE STRUCTURE

[75] Inventor: Enrique P. Gandara, Garland, Tex.

[73] Assignee: Gandara System, Garland, Tex.

[21] Appl. No.: 690,728

[22] Filed: Jul. 31, 1996

[51] Int. Cl.[6] ..... E04H 17/14; E04H 17/20

[52] U.S. Cl. ..... 256/24; 256/73

[58] Field of Search ..... 256/24, 25, 73, 256/DIG. 5; 52/770, 781, 814, 456, 169.2; 160/135

[56] References Cited

U.S. PATENT DOCUMENTS

| | | | |
|---|---|---|---|
| 2,715,017 | 8/1955 | Weimer | 52/761 X |
| 3,034,610 | 5/1962 | Lynch | 256/25 X |
| 3,037,593 | 6/1962 | Webster | 256/24 X |
| 3,101,929 | 8/1963 | Dvore | 256/24 |
| 3,305,221 | 2/1967 | Kling | 256/24 X |
| 4,736,566 | 4/1988 | Krotsch | 52/814 X |
| 5,494,261 | 2/1996 | Gandara | 256/24 |

FOREIGN PATENT DOCUMENTS

| | | | |
|---|---|---|---|
| 1071246 | 4/1954 | France | 52/789.1 |
| 863271 | 3/1921 | United Kingdom | 52/781 |

OTHER PUBLICATIONS

"Attractive and Durable, Color–Coated, Galvanized Steel" by Rohn Privacy Paneling. 1992.

"Unparalleled Style and Value for Commercial, INdustrial and Residential Use" advertising brochure, Momumental Iron Works. 1994.

*Primary Examiner*—Anthony Knight
*Attorney, Agent, or Firm*—Sidley & Austin

[57] ABSTRACT

A sheet metal fence of very few different components. A bottom fence panel assembly includes a corrugated panel with a lateral stiffener compression fit to each corrugated panel edge. A top panel assembly is identically formed. The ends of the top and bottom panel assemblies are inserted into respective channel-shaped half-posts that are anchored in the ground. Eight fasteners fasten the panel assemblies via only two of the lateral supports, to the half-posts, to thus provide a fence section with only eight total components, with three being different.

20 Claims, 4 Drawing Sheets

METAL FENCE STRUCTURE

TECHNICAL FIELD OF THE INVENTION

The present invention relates in general to fence structures, and more particularly to a metal fence structure that has very few components.

BACKGROUND OF THE INVENTION

Fences have been utilized for many centuries for a host of different purposes. As a result, many different types of fences and fence structures have been employed and styled to meet specific purposes. In view of the increase in population, as well as the density of the populace, especially in suburban and metropolitan areas, fences have emerged as a necessity for safety as well as privacy.

While many fences and dividers are constructed with brick, stone and other nondestructable materials, such type of fences are very costly and are not easily or quickly constructed. On the other hand, wooden fences comprised of a number of vertical boards placed edge to edge, have experienced a great deal of popularity, due basically to the low cost, availability and the expediency by which such type of fences can be constructed. The wooden type fences range from six to eight feet in height, and provide a substantial degree of privacy, as well as security in preventing unauthorized entry to the enclosed premises.

Wooden fences are generally constructed by anchoring either metal posts or wooden posts in the ground, often by a concrete base. Then, three or more lateral wooden supports are nailed or stapled between the posts. Lastly, the vertical wooden boards or slats are quickly nailed or stapled to the lateral supports, thus completing the fence. Hinged gates and the like can be made in a similar fashion, and fastened to the vertical posts by hinges and latch mechanisms. Many different types and variations of this type of fence are available. While the vertical posts are often made of a treated wood which is highly resistant to deterioration due to moisture and insects, the lateral supports and the vertical fence boards are often made of pine or cedar, and thus last only between five to ten years. It can be appreciated that a substantial disadvantage with wooden fences is thus the short life thereof, until some or all of the boards require replacing.

As a result of the popularity of the wood-type fences, the fabrication and the instillation of the same requires a high degree of efficiency to remain competitive. By and large, to remain competitive in installing fences, automatic nail and staple guns are utilized to expedite installation. While eight-foot sections of wood fences can be purchased pre-assembled, the installation time thereof is reduced, at the expense of increased cost.

A substantial advance in the field of fence structures was achieved in the fence structure described in U.S. Pat. No. 5,494,261 by Gandara, where an all-metal fence structure was disclosed that can be made and installed so as to be cost effective with the popular wood privacy fences. According to the patented Gandara fence, tubular metal posts anchor the fence sections in the ground. Vertical channel members supporting the fence sections along the vertical end edges are formed with a concave portion to accommodate the tubular fence post. While such post and fence structure overcomes many of the problems of the prior art, such structure can yet be improved upon to further reduce material and labor costs.

In accordance with the foregoing, a need exists for a fence structure that has very few different components, is economically fabricated and installed, and can withstand high wind loads. A further need exists for a fence structure that can be constructed primarily with precoated metal using contour roll forming techniques.

SUMMARY OF THE INVENTION

In accordance with the principles and concepts of the invention, the problems and shortcomings of the prior art fence structures are substantially reduced or eliminated. With regard to the preferred embodiment of the invention, a rigid, decay-resistant fence section includes only eight components, and of the eight components, three are constructed differently. The three different components that constitute the fence section according to the preferred embodiment, are a channel-shaped half-post, a lateral stiffener and a corrugated panel.

In order to construct a fence section, two such half-posts are required, in addition to four lateral stiffeners and two corrugated panels. Each corrugated panel is preferably about eight feet wide, with the corrugations extending vertically. A lower panel section includes a lower corrugated panel with two lateral stiffeners each compressively engaged with a respective top or bottom corrugated edge. A top panel section constitutes another corrugated panel with a pair of lateral stiffeners, each compressively engaging an opposing corrugated edge of the top panel.

The fence section of the invention constitutes one bottom panel section overlying and resting on the top panel section, and the ends of each panel section are held within the channel of the respective half-posts. When each half-post is set in the ground, such as by concrete, the fence section is a rigid structure, is aesthetically pleasing, and can withstand high wind loads.

Multiple fence sections can be ganged together by fastening one half-post of one fence section to another half-post of another fence section to thereby provide a high quality fence of any length.

In accordance with another feature of the invention, the half-posts of different fence sections can be angled with respect to each other and fastened together so that the fence sections can be installed around square or angled corners.

In accordance with an installation method according to the invention, two half-posts are set into the ground, such as by concrete, at spaced apart locations so that the post channels open toward or face each other. The ends of a bottom lateral stiffener are then inserted into the half-post channels and lowered to a location near the ground, and fastened by self-tapping screws, or the like, to the half-posts. A compression receptacle of the bottom lateral stiffener faces upwardly. The bottom corrugated panel is then lowered within the vertical channels of the half-posts, forced into the receptacle of the bottom lateral stiffener and held by a compression fit. A second lateral stiffener is then lowered within the vertical channels of the half-posts and compressively forced across the top corrugated edge of the bottom panel. In this manner, the bottom panel section is made rigid. In installing the top panel section, a third lateral stiffener is lowered in the half-post channels onto the lateral stiffener, with the compression receptacle facing upwardly. The top corrugated panel is then lowered and compressively pressed into the third lateral stiffener. Lastly, the fourth lateral stiffener is lowered within the vertical channels of the respective half-posts and compressively pressed onto the top corrugated edge of the top panel. The fourth lateral stiffener is then secured to the half-posts by self-tapping screws, or the like.

When multiple fence sections are ganged together, a pair of half-posts are fastened together, with the channels facing outwardly, and set into the ground. A similar pair of half-posts are set into the ground along the fence line about six feet from the first pair of half-posts. The top and bottom panel sections are installed in vertical channels of the half-posts in the manner described above.

In accordance with yet another feature of the invention, all of the fence structure components, except the corrugated panels, are adapted for fabrication by contour roll forming equipment. Moreover, the entire fence structure is adapted for fabricating with sheet metal components that are precoated with a desired color.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts, elements or functions throughout the views, and in which.

DETAILED DESCRIPTION OF THE INVENTION

Figure 1:
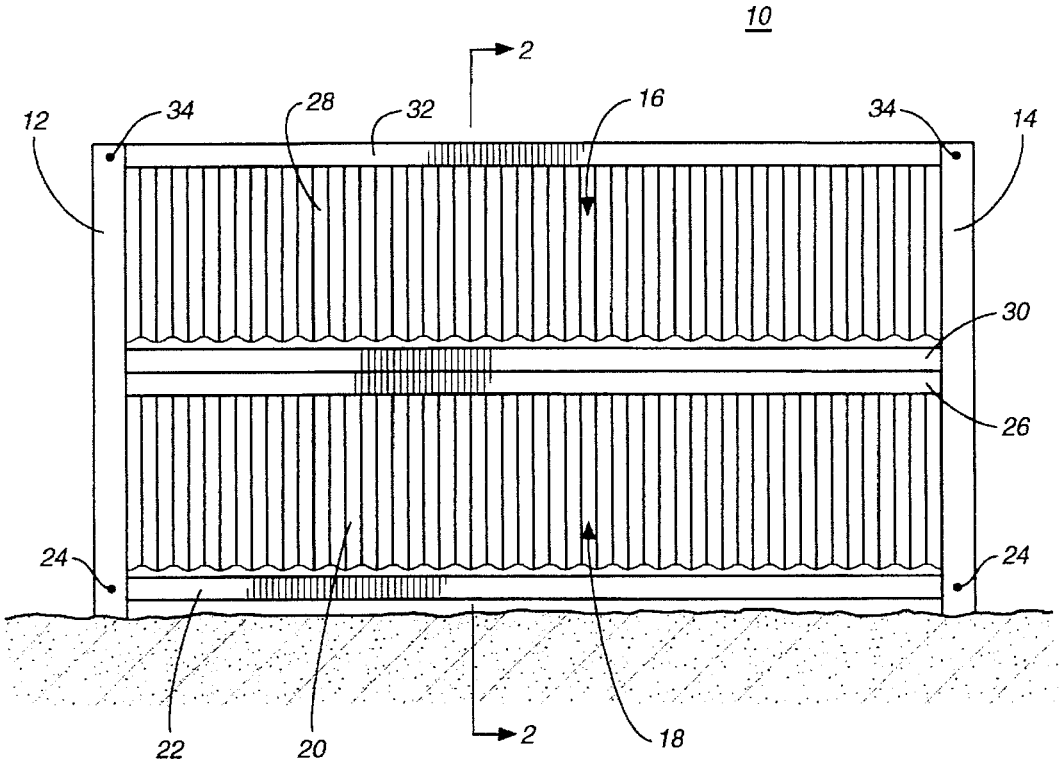
FIG. 1 is a side plan view of a fence section according to the preferred embodiment of the invention.

FIG. 1 illustrates a fence panel section 10 constructed according to the preferred embodiment of the invention. The components of the fence structures are constructed entirely of a precoated galvanized sheet metal to provide a corrosion resistant fence with an extremely long life. Coils of precoated sheet metal are currently available with various colors, embossing, laminating and striping designs. An important feature not available with wood fences, is that the present fence structure does not have a back side or front side for appearance purposes, but rather the front and back sides of the fence are symmetrical and thus are identical in appearance.

Each fence section 10 includes two half-posts 12 and 14 that are installed in a spaced apart manner and anchored into the ground by concrete or other suitable means. The half-posts are initially set into the ground about eight feet apart to accommodate two fence panel assemblies that are about eight feet long. Each half-post 12 and 14 is formed in a cross-sectional U-shape to accommodate a top panel assembly 16 and a bottom panel assembly 18. The half-posts 12 and 14 are anchored in the ground with the U-shaped channels facing each other so as to receive therein the ends of the top panel assembly 16 and the bottom panel assembly 18.

The bottom panel assembly 18 includes a corrugated panel 20 that is about eight feet wide so as to be captured within the channels of the half-posts 12 and 14. A first lateral stiffener 22 is constructed as a channel receptacle so as to compressively fit onto the bottom corrugated edge of the bottom corrugated panel 20. The first lateral stiffener 22, like the other three lateral stiffeners to be described, extends between the half-posts 12 and 14 and is snugly captured within the vertical U-shaped channels thereof. During installation of the first lateral stiffener 22, it is fastened at each end thereof to the respective half-posts 12 and 14 by four self-tapping screws, rivets or other suitable fasteners, two of which are shown by reference numerals 24. The lower panel assembly 18 further includes a second lateral stiffener 26 that is fabricated substantially identical to the first lateral stiffener 22. The second lateral stiffener 26 includes a channel receptacle for compressively supporting the top corrugated edge of the corrugated panel 20. In this manner, with the top and bottom corrugated edges of the panel 20 being compressively supported by stiffeners, a high degree of rigidity to the panel is provided. The second lateral stiffener 26 of the bottom panel assembly 18 need not be fastened to the respective half-posts 12 and 14, but it could be.

The top panel assembly 16 includes a corrugated panel 28 substantially identical to the bottom corrugated panel 20. In addition, the top corrugated panel 28 also includes a bottom lateral stiffener 30 and a top lateral stiffener 32, both of which are substantially identically constructed. Indeed, all four lateral stiffeners of the fence section 10 shown in FIG. 1 are identical components of the fence as to size, shape, length and color. In like manner, and as noted above, the bottom and top corrugated panels 20 and 28 are substantially identical to each other. As further noted in FIG. 1, the third, or bottom lateral stiffener 30 of the top panel assembly 16 rests upon the top lateral stiffener 26 of the bottom panel assembly 18. Neither lateral stiffener 26 or 30 need to be fastened to the respective half-posts 12 and 14. The fourth, or top lateral stiffener 32 of the top panel assembly 16 is fastened to the respective half-posts 12 and 14 by four threaded fasteners, two of which are shown as reference numerals 34. In this manner, the top panel assembly 16 and the bottom panel assembly 18 are secured to the half-posts 12 and 14 and no components of the fence can be separately removed without removing some or all of the fasteners.

In accordance with an important feature of the invention, various components of either panel assembly can be easily removed and replaced should damage be incurred. Indeed, by simply removing the four top fasteners 34, any component of either panel assembly 16 or 18 can be easily removed, except for the bottom lateral stiffener 22 of the bottom panel assembly 18. The bottom lateral stiffener 22 can only be replaced by removal of the components that rest above it, in addition to the removal of the four threaded fasteners 24. As will be described more fully below, an additional feature of the invention is that the half-posts 12 and 14 need not be spaced apart with a high degree of accuracy in order to fasten the top and bottom panel assemblies 16 and 18 thereto. Indeed, the irregularity in the spaced apart nature of the half-posts 12 and 14 can be several inches, without affecting either the appearance or integrity of the fence section 10.

Although the fence section 10 can be fabricated with many different component sizes and materials, it is preferred that all components be constructed of a precoated sheet metal. To that end, the various components of the fence section 10 can be fabricated from rolls of precoated sheet steel. The precoating preferably includes a galvanized coating covered by a protective color coating. In order to make the appearance of the fence section 10 appear as wood, those skilled in the art may prefer to employ sheet steel material embossed with a wood grain and coated with a corresponding wood color. With regard to the corrugated panels 20 and 28, they can be fabricated using the precoated roll of sheet steel processed by a corrugating machine. A corrugated machine well adapted for corrugating precoated sheet steel is disclosed in pending U.S. patent application Ser. No. 08/510,587, filed Aug. 21, 1995, the disclosure of which is incorporated herein by reference.

The corrugated panels 20 and 28 are preferably fabricated with a precoated galvanized thirty gauge sheet metal. The panels 20 and 28 are preferably 36 or 48 inches in height and ninety-five inches in width. The corrugations of the panels 20 and 28 preferably have a peak-to-valley dimension of about 1.125 inches. The peak-to-peak lateral dimension is about 3.5 inches. Each of the four lateral stiffeners 22, 26, 30 and 32 are constructed of a precoated galvanized twenty-two gauge sheet metal. In all of the components of the fence section 10, it is preferable that the sheet metal be galvanized and precoated on both sides thereof.

Figure 2:
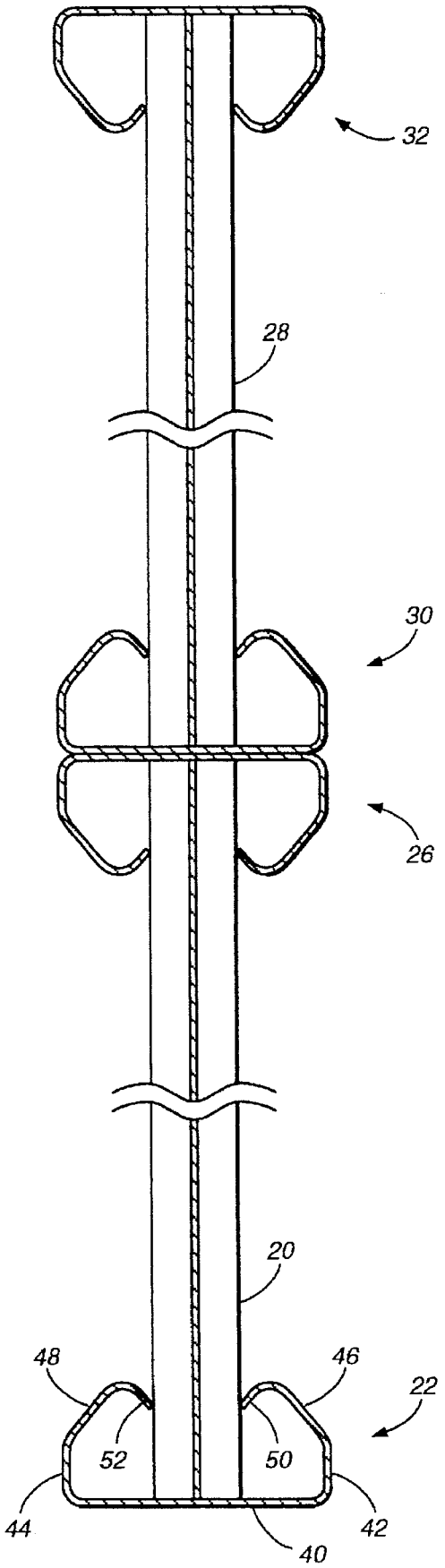
FIG. 2 is a vertical cross-sectional view of the fence section, taken along line 2—2 of FIG. 1.

FIG. 2 illustrates in more detail the structural features of the fence section 10. As noted above, the upper corrugated panel 28 and the lower corrugated panel 20 are constructed of a thirty gauge sheet metal, preferably of 36 or 48 inch height and 95 inches in width. The corrugated panels 28 and 20 have formed therein surface irregularities, preferable vertical corrugations to provide rigidity and strength thereto. Of course, those skilled in the art may prefer to construct the corrugated panels 28 and 20 of different size and shapes of corrugations. Indeed, irregular shaped surfaces or corrugated panels having angled sides and flat outer surfaces may be utilized to achieve acceptable rigidity. In accordance with an important feature of the invention, the upper corrugated panel 28 and the lower corrugated panel 20 are constructed identically, and thus are interchangeable.

The four lateral stiffeners 22, 26, 30 and 32 are all constructed identically, and thus are fully interchangeable. The four lateral stiffeners are preferably constructed with the general shape shown in FIG. 2. The lateral stiffeners each have a respective flat surface 40 that define the general top or bottom of the fence section 10, depending upon whether the stiffener is installed at the top or bottom of the fence. When employed as the lateral stiffeners 26 and 30 between the top and bottom panel assemblies 16 and 18, the flat surfaces 40 facilitate a stable contact engagement therebetween. The flat surface 40 of each lateral stiffener is preferably, although not necessarily, about 3.5 inches wide. Opposing parallel sides 42 and 44 are about 1 3/16 inches high, and are curved inwardly with slanted sides 46 and 48 that terminate in opposing inwardly curved edges 50 and 52. The elongate curved edges 50 and 52 are spaced less than 1.125 inches apart to compressively accommodate the width of the corrugated panels 20 and 28. The inside of each of the four internal corners of the lateral stiffeners are formed with a radius of about 0.25 inch. The curved edges 50 and 52 are formed with a radius of about 0.375 inches. The cross-sectional shape of each lateral stiffener is uniform throughout the length thereof.

Each irregular corrugated edge of the panel, such as panel 20, fits snugly between the edges 50 and 52 of respective stiffeners. Indeed, as the corrugated panel 20 is forcefully pushed into the channel opening of the stiffener 22, the angled members 50 and 52 yield and are forced apart somewhat, thereby providing a slight compression fit to the corrugated edge of the panel 20. In this manner, the panel 20 does not loosely engage with the lateral stiffener 22 and thereby allow the panel to rattle when vibrated, such as when subjected to wind turbulence. Rather, each lateral stiffener firmly secures the respective corrugated panel therein. As noted in FIG. 2, the curved edges 50 and 52 provide a tapered entrance into the channel, thus facilitating pushing of the panel 20 therein by guiding the corrugated panel edge into the channel receptacle. In other words, the angled configuration of the lateral stiffeners provides a guiding function and a snug fit to the corrugated panels. As noted in FIG. 2, the corrugated panel 20 is inserted into the respective top and bottom lateral stiffeners 26 and 22 until it bottoms out, thereby facilitating installation. The upper corrugated panel 28 similarly fits into the respective top and bottom lateral stiffeners 32 and 30.

The interchangability of all the lateral stiffeners reduces the number of different components necessary to construct the fence section 10. The reduced number of different components also facilitates the ease with which the components can be selected and the fence constructed.

Figure 3:
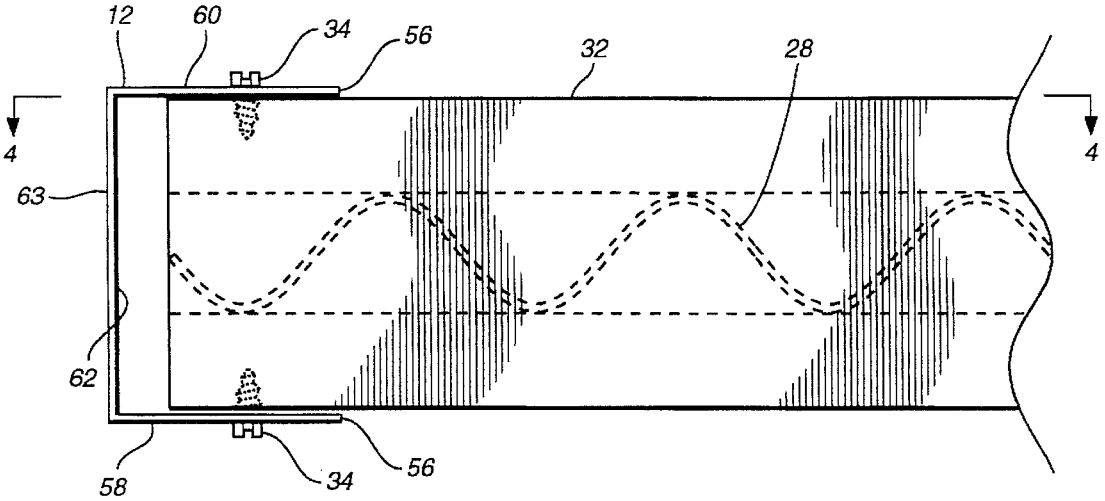
FIG. 3 is a top view of a portion of the fence section, showing the engagement of the top panel section to a channeled half-post.

With reference now to FIG. 3, there is depicted the manner in which the lateral stiffeners are fastened or otherwise attached at one end to the respective half-posts. It should be noted that while FIG. 3 illustrates the attachment of the fence components to one half-post 12 of one section, an identical arrangement is achieved with respect to the other half-post (not shown) of the same fence section. The half-post 12 is preferably constructed of a sixteen gauge precoated galvanized sheet metal in the same color as the lateral stiffeners. For fences constructed of typical 6-foot heights, the half-post 12 is preferably about 96 inches long, the bottom two feet thereof being anchored in the ground. For eight foot high fences, the half-post 12 can be constructed of a 14 gauge sheet metal, with two or more feet thereof buried in the ground. In accordance with another important feature, the half-posts 12 and 14 are preferably fabricated with a grade 80 steel. It is contemplated that when the fence section 10 is constructed according to the preferred embodiment disclosed herein, such structure can withstand a 100 mph wind force. Very few, if any, wood fences can withstand such a side load due to wind forces. Each of the elongate vertical edges 56 of the half-post are rounded to eliminate injury due to cutting. In accordance with another feature of the invention, the metal components of the fence section 10 have very few exposed edges, thereby reducing the possibility of inadvertent injury. The inside dimension between the parallel sides 58 and 60 of the half-post 12 is preferably about 3.5 inches. The lateral dimension of each side 58 and 60 is about 2 3/16 inch. The lateral stiffeners can be fabricated of precoated sheet metal using contour roll forming machines. In like manner, the half-posts 12 and 14 can also be formed by contour roll forming machines.

As noted in FIG. 3, it can be seen that the lateral stiffeners each snugly fit within the parallel sides 58 and 60 of the respective half-posts. The bottom and top stiffeners 22 and 32 of the fence section 10 are fastened to the half-post 12 by a single self-tapping threaded fastener or rivet 24 and 34, on the front and back side of the fence. The middle stiffeners 26 and 30 of the fence section 10 do not need to be fastened to either of the half-posts 12 or 14. This relatively few number of fasteners does not compromise the integrity or rigidity of the fence section 10, but reduces the time required for assembly and installation thereof. The number of fasteners required on one side of the fence section 10 is four, as shown in FIG. 1, it being realized that an equal number of self-tapping fasteners are utilized at the same respective locations on the other side of the fence section 10.

It is noted in FIG. 3 that none of the lateral stiffeners need be fully abutted against the inside flat surface 62 of the half-post 12. This allows a fence section 10 of a specified width to be installed between half-posts that may vary by a few inches in the distance by which the posts are spaced apart. With this construction, the lateral stiffeners remain captured between the parallel side walls 58 and 60 of the half-posts, even if the posts are spaced apart several inches more than they should be. This flexibility in the installation of the fence of the invention reduces criticality in the exact distance apart by which the posts are set into the ground.

Figure 4:
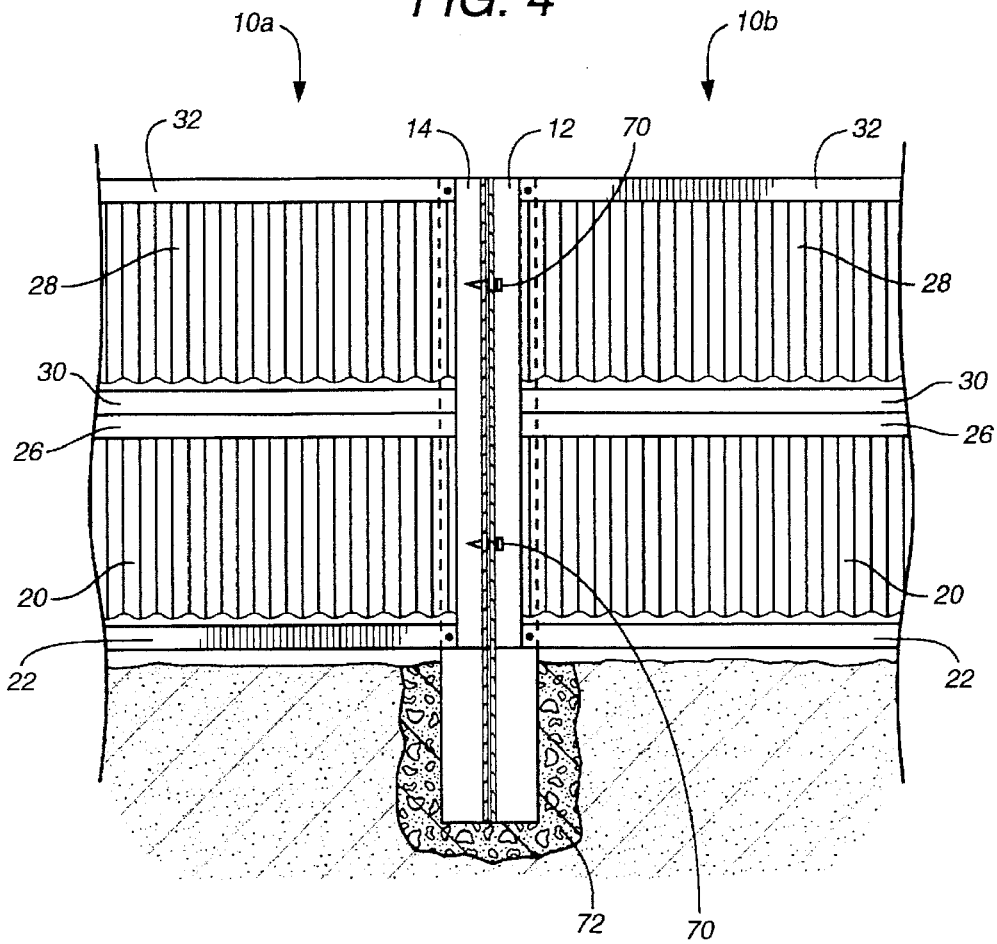
FIG. 4 illustrates a portion of two fence sections engaged together by way of the half-posts thereof, which are shown in partial cross-section.

FIG. 4 illustrates the manner in which one fence section 10*a* is joined to another similar fence section 10*b*. The half-post 14 of the first fence section 10*a* is attached to the half-post 12 of the second fence section 10*b*. The half-posts 12 and 14 can be attached directly together by engaging the flat surfaces 63 (FIG. 3) together such that the respective U-shaped channels open outwardly in opposite directions. Then, preferably two self-tapping screws 70 are driven through the half-posts 12 and 14, as shown in FIG. 4. In the event a fence section 10 ends without being connected to another section, then the half-post of the last section need not be attached to another half-post. As can be seen in FIG. 3, each half-post has a flat exterior surface 63 that is color-coated and provides an aesthetically pleasing termination of a fence section.

Preferably at least two feet of the bottom portion of the fastened half-posts 12 and 14 are anchored in cement 72. Once all of the fastened pairs of half-posts are set in the ground, a string can be stretched across a number of posts to establish where the first or bottom lateral stiffeners 22 are to be attached to the half-posts. Depending on the various preferences, the first lateral stiffener 22 can either rest on the ground, or be a few inches off the ground and aligned with the bottom stiffeners of the other sections. Each half-post can be marked as to the location where the bottom self-tapping screws 24 are to fasten the first lateral stiffeners 22 thereto. When the half-posts are appropriately marked, the assembly of the fence can commence by fastening the first lateral stiffeners 22 between each spaced-apart half-post 12 and 14. The fasteners 24 shown in FIG. 1 serve this purpose. Thereafter, the bottom panel assembly 18 and the top panel assembly 16 can be assembled in the manner described above.

Figure 5:
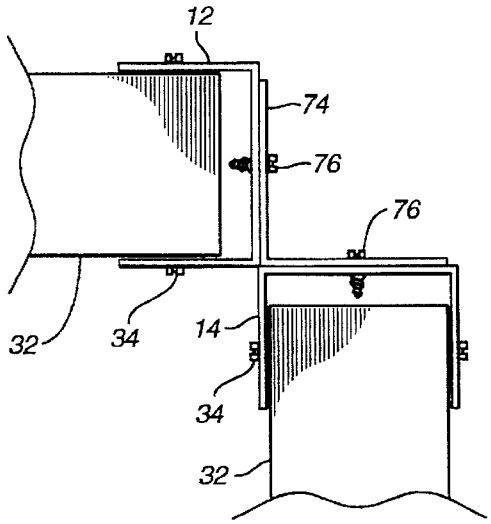
FIG. 5 shows the manner in which half-posts are connected together so that the fence sections can be installed around a right angle corner.
Figure 6:
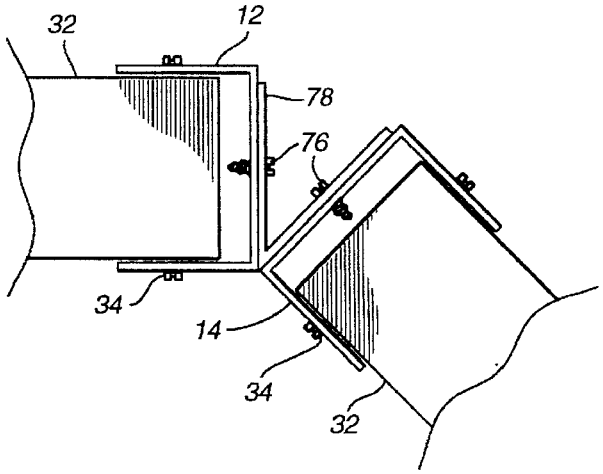
FIG. 6 illustrates the attachment of two half-posts so that the fence section can be installed at an obtuse angle.

With reference now to FIG. 5, there is illustrated the manner in which one fence section is installed at 90° with regard to an adjacent fence section. A right angle bracket 74 is formed so that it extends substantially along the entire length of the portion of the half-posts 12 and 14 that protrudes above the ground. Such bracket 74 is attached to the half-posts to form the right-angle orientation of the joined fence sections. Two or more self-tapping screws 76 are utilized to fasten each of the legs of the bracket 74 to the respective half-posts 12 or 14. The angle bracket 74 can be formed of a precoated galvanized sheet material and bent at the appropriate angle. To that end, by bending the bracket 74 to an angle other than 90°, adjacent fence sections can be joined together at various angles. In FIG. 6 there is illustrated an angle bracket 78 that is bent to an internal acute angle so that when fastened to adjacent half-posts 12 and 14, the fence can be installed at an internal obtuse angle.

While not specifically illustrated in the drawings, a gate can be formed in substantially the same manner as a fence section 10, with a width of the same or smaller dimensions. Obviously, the half-post ends of a gate are cut shorter and are not fastened in the ground. Also, rather than fastening one half-post 12 to the other half-post 14 by screws, rivets or the like as with ganged fence sections, such half-posts can be linked together by two or more hinges attached to the side surfaces 58 or 60 of the half-posts. In this manner, a hinged gate or fence section is provided. In addition, conventional gate latches can be fastened to the other side to allow the gate to be latched or otherwise secured.

Figure 7:
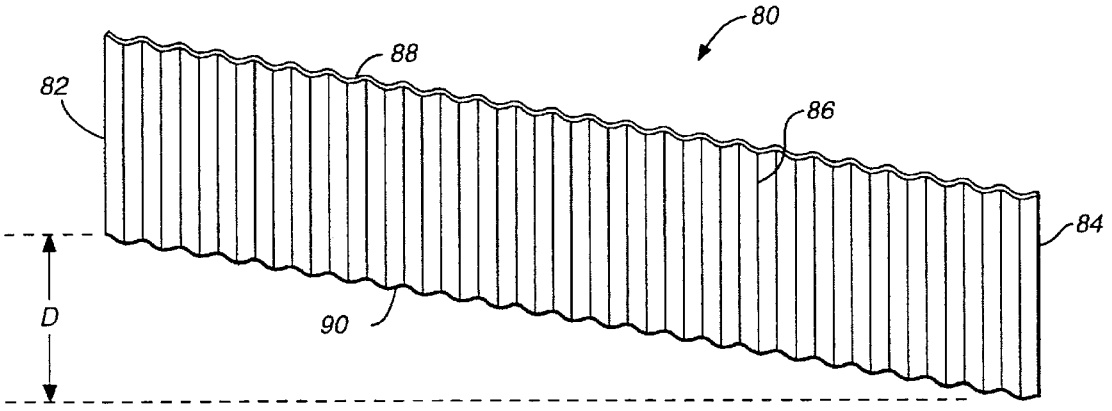
FIG. 7 is a frontal view of a corrugated panel that can be utilized with fence sections situated on inclined ground surfaces.

FIG. 7 illustrates a corrugated panel 80 adapted for use with fence sections 10 that are installed over inclined ground surfaces. The panel 80 is trapezoid in shape, with vertical side edges 82 and 84, as well as vertical corrugations 86. However, the top edge 88 and the bottom edge 90 are not perpendicular with respect to the side edges 82 and 84, but rather are angled to match the general angle of incline of the ground. Two such corrugated panels 80 are utilized in conjunction with four lateral stiffeners and half-posts as described above, to construct the fence section 10. A number of different trapezoidal-shaped panels 80 can be constructed to match various angles of ground incline. With eight foot wide corrugated panels 80, standard trapezoidal shapes can be achieved by making the distance D in FIG. 5, for example, 5 inches, 10 inches, 15 inches and 20 inches, etc. Gate structures can also be constructed in a manner similar to the inclined fence sections 10 to accommodate inclined ground surfaces.

From the foregoing, disclosed is a fence structure that overcomes the shortcomings and disadvantages of the prior art fences. While the preferred embodiment of the invention has been disclosed with reference to a specific fence structure and corresponding methods of installation, it is to be understood that many changes in detail may be made as a matter of engineering choices without departing from the spirit and scope of the invention as defined by the appended claims.

What is claimed is:

1. A fence structure, comprising:

a pair of post members, each having at least a portion thereof that is cross-sectionally channel shaped;

a first panel assembly comprising a corrugated panel and a pair of lateral stiffeners, each lateral stiffener having a channel receptacle for receiving therein an opposing corrugated edge of the corrugated panel, each end of said pair of lateral stiffeners being insertable within a respective channel of the post members; and a second panel assembly constructed substantially identical to said first panel assembly, whereby when said first and second panel assemblies are inserted one over the other within the respective channels of said post members, a rigid fence structure is formed.

2. The fence structure of claim 1, wherein said post members and said lateral stiffeners are formed of sheet metal.

3. The fence structure of claim 1, wherein each said lateral stiffener is substantially identical.

4. The fence structure of claim 1, wherein each component of said fence structure is formed of sheet metal precoated on both sides thereof.

5. The fence structure of claim 1, further including a plurality of said fence structures ganged together to form a repeatable fence when a flat surface of one said post member is fastened to a post member of another said fence section.

6. The fence structure of claim 1, wherein said fence structure includes only two identical said post members, four identical shaped said lateral stiffeners, and two identical shaped said corrugated panels.

7. The fence structure of claim 1, wherein each said lateral stiffener has curved surfaces that yield when the corrugated edges of a panel are inserted therein to thereby provide a compression fit with said corrugated panel edges.

8. The fence structure claim 1, wherein neither said corrugated panel is fastened directly to either said post member.

9. The fence structure of claim 8, wherein neither said corrugated panel is fastened directly to any said lateral stiffener.

10. The fence structure of claim 1, wherein no edges of said first and second panel assemblies are exposed after insertion thereof within the respective channels of the post members.

11. The fence structure of claim 1, wherein both face sides of each said fence structure are identical in appearance.

12. The fence structure of claim 1, including a second said fence structure defining a gate, hinged to a post member.

13. The fence structure of claim 1, wherein each said corrugated panel is trapezoidal-shaped.

14. A method of fabricating a fence structure, comprising the steps of:

forming four identical lateral support members of sheet metal with two elongate sides thereof joined together to define a channel receptacle, and where said elongate side edges have a curved portion to allow a guiding entry to said channel receptacle;

forming two identical corrugated panels each with a peak-valley dimension that is greater than a transverse entry dimension of the channel receptacle of said lateral support members; and forming of sheet metal two identical half-posts having opposing sides spaced apart to receive therein an end of each said lateral support member.

15. The method of claim 14, wherein said four lateral support members and said two half-posts are roll formed using a precoated sheet metal.

16. A fence structure fabricated according to the method of claim 14.

17. A fence structure, comprising:

a first fence section, including, a) at least one corrugated panel constructed of a rigid material;

(b) a first and second sheet metal lateral stiffener engageable with respective corrugated edges of said corrugated panel, each said lateral stiffener being identically constructed and including, a channel receptacle having a planar base and sides generally orthogonal to said planar base, said sides having a portion extending toward each other to define an entrance opening to said channel receptacle, said extending portion including elongate curved portions to facilitate guiding a respective corrugated panel edge therein, said entrance opening to said channel receptacle being of a lateral dimension that is smaller than a peak-to-valley dimension of said corrugated panel, whereby said corrugated panel edge is compression fit within the entrance opening of said channel receptacle;

c) a pair of post members adapted to be set at spaced-apart locations within an earth material, each said post member being constructed of sheet metal and including a planar base and orthogonal sides defining a channel, said post member channel for receiving therein respective ends of said lateral stiffeners; and a second fence section constructed substantially identical to said first fence section, and including one or more fasteners for fastening a planar base of a post member of said first fence section to a planar base of a post member of said second fence section.

18. The fence structure of claim 17, wherein said corrugated panel and said first and second lateral stiffeners define a first panel section, and further including an identical second said panel section inserted in respective channels, over said first panel section, of said spaced-apart post members.

19. The fence structure of claim 17, further including a gate structure constructed substantially identical to said first fence section, except being of narrower width, and attached to said first fence section with a pair of hinges.

20. The fence structure of claim 17, wherein said lateral stiffeners and said post members are roll formed from sheet metal that is precoated on each side thereof with a protective and color coating.

* * * * *